United States Patent [19]

Reiland et al.

[11] Patent Number: 4,775,068

[45] Date of Patent: Oct. 4, 1988

[54] COLLAPSIBLE CONTAINER WITH REMOVABLE ACCESS PANEL

[75] Inventors: Cheryl Reiland, Federal Way; Mark Hillis, Tacoma; John A. Malmanger, Vashon Island, all of Wash.

[73] Assignee: Xytec Plastics, Inc., Tacoma, Wash.

[21] Appl. No.: 141,722

[22] Filed: Jan. 11, 1988

[51] Int. Cl.[4] ..... B65D 6/18

[52] U.S. Cl. ..... 220/6; 220/1.5

[58] Field of Search ..... 220/6, 7, 1.5

[56] References Cited

U.S. PATENT DOCUMENTS

| | | | |
|---|---|---|---|
| 2,780,382 | 2/1957 | Beckner et al. | 220/6 |
| 3,861,554 | 1/1975 | Legg et al. | 220/1.5 X |
| 4,043,476 | 8/1977 | Joseph | 220/7 X |
| 4,591,065 | 5/1986 | Foy | 220/7 |
| 4,674,647 | 6/1987 | Gyenge et al. | 220/1.5 X |

*Primary Examiner*—Steven M. Pollard

*Attorney, Agent, or Firm*—Kolisch, Hartwell & Dickinson

[57] ABSTRACT

A collapsible bin with side and end walls pivoted to a pallet base. The walls pivot inwardly to collapse the bin. With the walls upright, adjacent edges of the walls interlock to prevent swinging of the walls outwardly from a vertical. At least one wall has a removable access panel detachably mounted in an outer frame section of the wall. The access panel is removable without affecting the integrity of the structure interlocking the edges of the walls.

4 Claims, 4 Drawing Sheets

COLLAPSIBLE CONTAINER WITH REMOVABLE ACCESS PANEL

BACKGROUND AND SUMMARY OF INVENTION

This invention relates to collapsible containers, sometimes referred to as bins, of the type which have a base which includes a portion forming the floor of the container, and upstanding side and end walls mounted on the base forming the sides of the container. The ends walls are mounted in such a way as to enable them to be positioned in stacked relation over the base, either by pivoting the walls inwardly so that they fold over the base or by detachably mounting the walls whereby they may be detached and then stacked, thus to collapse the container.

Containers of this description have a wide variety of uses. Thus, the containers range in size from relatively large capacity cargo container units for rail and shipboard handling to rather small, lightweight containers designed for commodities such as bakery goods and farm produce. Containers of an intermediate size have been widely used in the automotive and other manufacturing industries in the handling of parts and supplies used in the manufacturing process. The collapsibility of the containers facilitates their return shipping to the original supplier.

A popular form of collapsible container at the present time is one made entirely or substantially entirely from plastic materials formed by molding such as injection molding techniques. For example, the walls and base of the container may be formed from a high density polyethylene and utilizing injection molding to form the components. Containers of this description have relatively light mass and are manufactured relatively inexpensively. A collapsible container of this description forms the subject matter of Gyenge, et al., U.S. Pat. No. 4,674,647.

A problem which arises in the construction of collapsible containers is the provision of means affording access to the container interior through a side of the container. Such access is desirable since it eliminates the requirement to lean over and into the container when withdrawing product from the container. So-called drop gates have been proposed, provided in one or more walls in the container, which are pivotally mounted in place and swung to one side to open up an access opening. However, the size of such a gate is limited, if the gate is to hang vertically downwardly in an opened-up position and be out of the way. Additionally complicating the problem is that containers during use are subjected at times to considerable forces exerted outwardly on the container walls, thus to stress the walls. Thus, any construction provided permitting access through a side wall must have a construction not significantly impairing the strength of the wall. Furthermore, where access is to be provided through a side of the container, preferably it should be in such a manner as not to affect the integrity of the corner structure in the container that maintains the walls of the container in their upright position.

A general object of this invention is to provide a collapsible container with a new and improved construction for providing access to the interior of the container through a side thereof.

A related object is to provide such a container where access is provided through incorporation in the container, in a side thereof, of a removable access panel which on removal opens up an access opening closed by the panel with the panel in place.

A more specific object is to provide a collapsible container which contains a removable access panel with a novel mounting for the panel where the wall mounting the panel is braced in such a way as to retain its strength. A related object is to provide such a container where the mounting of the panel in a wall is through interfitting tongue and socket structure serving firmly to hold the access panel in the remainder of the wall.

As contemplated by this invention, the container includes opposed side and end walls pivotally mounted on a base which includes a portion forming the floor of the container. The container is collapsed by swinging the walls inwardly whereby they fold over each other over the container base. At least one of the walls is a sectional wall including an outer frame section with portions forming the perimeter of the wall along the base and side margins of the wall, and an access panel detachably mounted in this outer frame section. The access panel has downwardly projecting tongue portions along its opposite margins received within upwardly facing sockets presented by the frame section of the wall. The tongue and sockets interengage with shifting of the access panel downwardly into the frame section in a direction generally paralleling the plane of the sectional wall. With the access panel seated and in place, it becomes firmly held in a unified manner with the frame section of the wall. The wall effectively withstands stresses such as bowing stresses exerted thereon by reason of a load contained within the container. The access panel is readily removed to provide a relatively large access opening to the container interior. After removal of the contents of the container, returning of the access panel and latching it into place, the panel and frame section of the sectional wall again become unified and swingable as a unit over the base of the container to prepare the container for return shipment to the supplier.

These and other objects and advantages are obtained by the invention which is described herein below in conjunction with the accompanying drawing, wherein.

Figure 1:
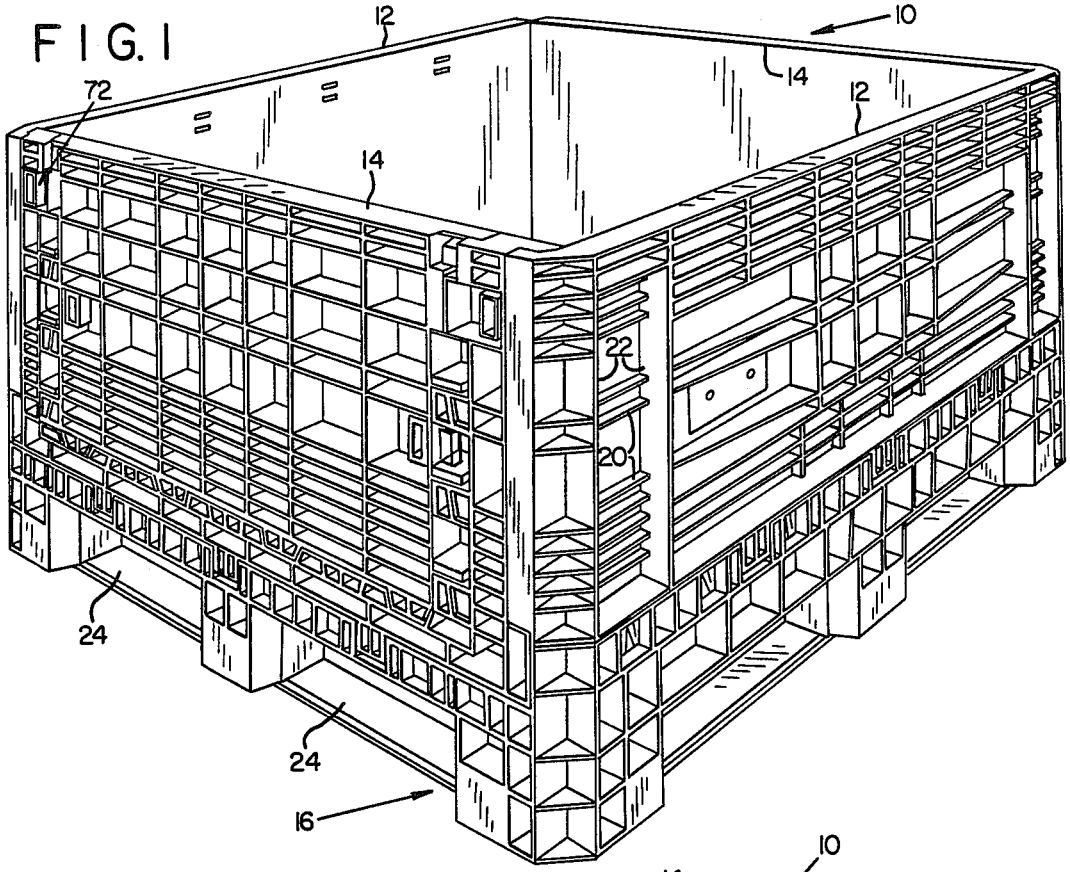
FIG. 1 is a perspective view, illustrating a container constructed as contemplated herein.
Figure 2:
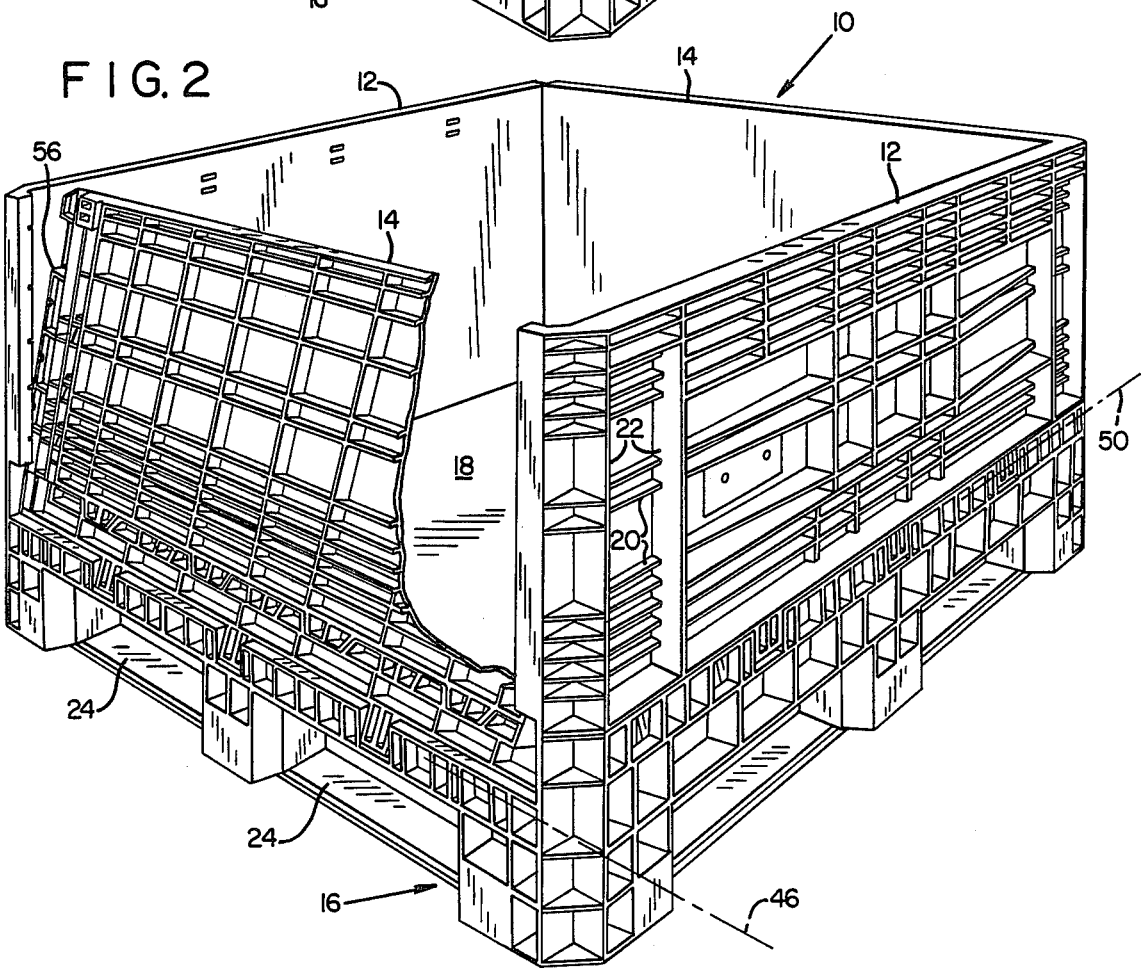
FIG. 2 is a perspective view, illustrating the container with one of its walls swung slightly inwardly and with a portion of the wall broken away to illustrate the floor of the container.

Referring now to the drawings, and more particularly to FIGS. 1 and 2, a collapsible bin or container is shown generally at 10 which includes, in the erected condition illustrated in FIG. 1, a pair of opposed upstanding walls 12, referred to herein arbitrarily as side walls, and extending normal to these side walls 12, a pair of opposed upright walls 14, arbitrarily referred to as end walls. The side and end walls are pivotably mounted on what is referred to herein as a pallet base 16.

The side and end walls and pallet base may be formed from a high-density polyethylene as molded parts using injection molding techniques. While the inner surfaces of the side walls and end walls, as well as the surface of the floor 18 of the bin (the floor being part of the pallet base) may be and preferable are formed as smooth, substantially uninterrupted surfaces, the walls and pallet base on their external sides are provided with appropriate strengthening webs distributed thereover as exemplified by the webs and ridges illustrated at 20 and 22.

The pallet base, in addition to having floor 18, includes a support wall around the bottom periphery thereof and spaced apart openings 24, two per side, which adapt the pallet for lifting by the tines of a fork lift. With this organization, the bin may be picked up from any side by a fork lift for transport.

The side and end walls may be pivotably mounted on the pallet base using various forms of hinge or pivot constructions. In the bin disclosed herein, the pivot mounting of the walls is through hinge structures which are the same as those described in U.S. Pat. No. 4,674,647.

Figure 5:
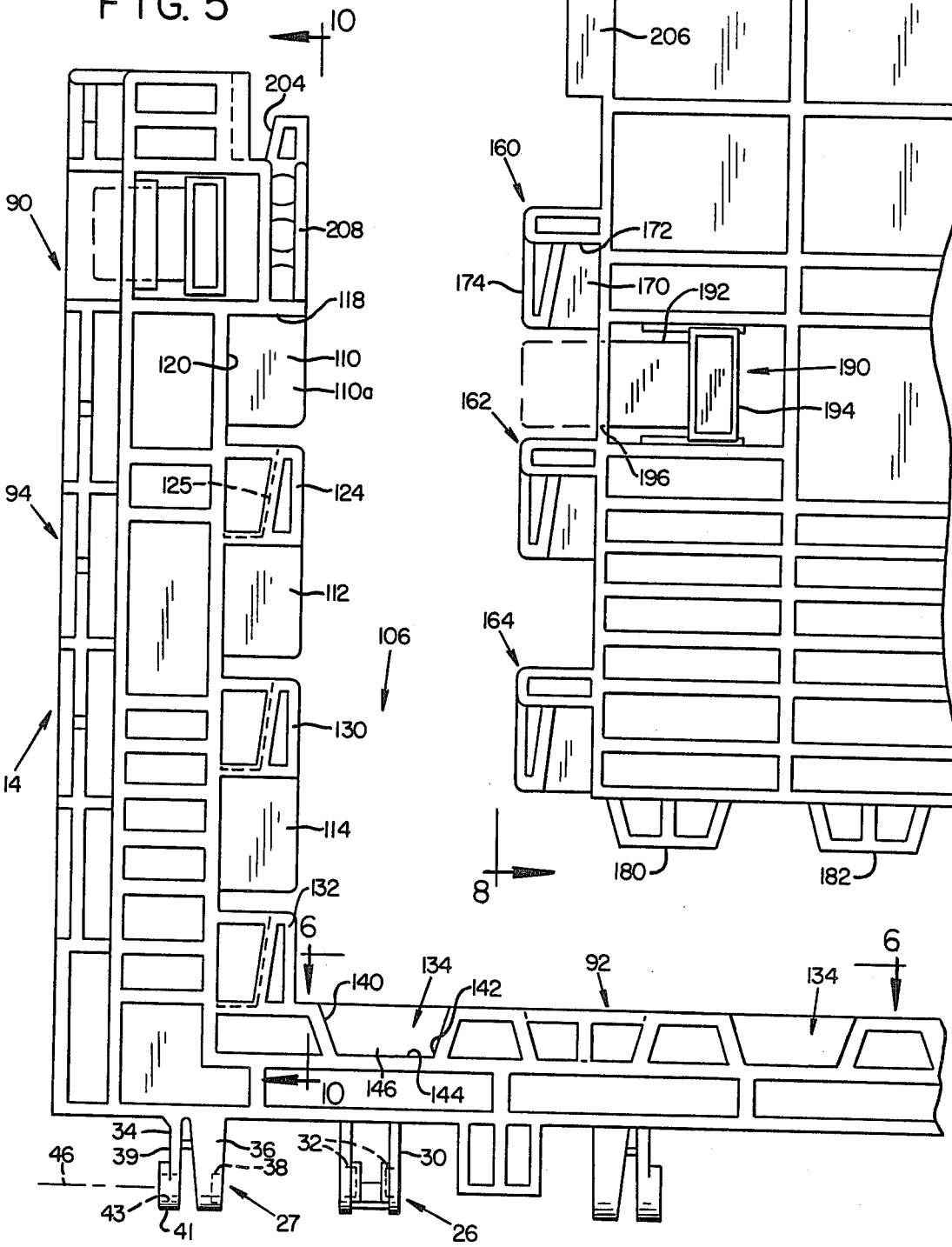
FIG. 5 is a side elevation, illustrating a portion of the outer frame in the sectional wall of the container.

Thus, and referring to FIG. 5 which illustrates on a slightly enlarged scale lower portions of end wall 14 that face the viewer in FIGS. 1 and 2, hinge structures 26 and 27 depending from the bottom of the wall may be employed for pivotally mounting the wall on the pallet base. Hinge structure 26 includes a substantially rectangular hinge body 30 extending from the bottom edge of the wall. The sides of the hinge body are provided with slots 32 which fit about and thus engage suitable bosses or cylindrical protrusions presented by the pallet base. As discussed in U.S. Pat. No. 4,674,647, the slots are open ended on the inward side of the wall, i.e., are U-shaped, to permit by lateral movement of the wall insertion of the bosses into the U-shaped slots. Hinge structure 27, used in conjunction with hinge structure 26, may be characterized as a "snap hinge", and has the added function of retaining the wall against removal from the pallet base. Thus, the hinge structure, which like hinge structure 26 is molded integral with the wall, has two parts comprising a body 34 and a member 36. Body 36 is similar to one side of hinge body 30, in that it contains an open ended slot 38 designed to receive a cylindrical hinge boss presented by the pallet base. Body 34 has a relatively thin walled shank 39 terminating in a cylindrical hub 41 which is provided with a bore 43 for receiving a boss presented by the pallet base. Since shank 39 is somewhat flexible, it may be deformed to such an extent as to allow the boss to engage bore 43 to snap the hub into position. Slots 32, 38, and bore 43 of the various hinge structures are all appropriately aligned so there is provided with the wall mounted in place on the pallet base a pivot axis extending generally as shown by the dot-dash line 46 in FIG. 5. For a further description of the hinge structure just described, reference is made to U.S. Pat. No. 4,674,647.

In FIG. 2, pivot axis 46 for the end wall 14 which is closest to the viewer is set forth, such extending across the bin in a horizontal direction and at an elevation which is slightly above the elevation of floor 18. A similarly located pivot axis is provided for the other end wall 14. This organization permits the end walls to be collapsed by swinging them inwardly so that both walls extend over the floor, with one wall overlapped and folded over the other wall. A similar pivot structure may be provided for pivotally mounting side walls 12. In the case of the side walls, as exemplified by axis 50, the pivot axes for the walls extend horizontally across the bin but at a slightly higher elevation than axes 46 for walls 14. This enables the side walls, when collapsing the bin, to be folded inwardly to be supported in a horizontal position disposed over the inwardly folded end walls. Side and end walls which are similarly folded to a collapsed state are disclosed in U.S. Pat. No. 4,674,647.

Figure 7:
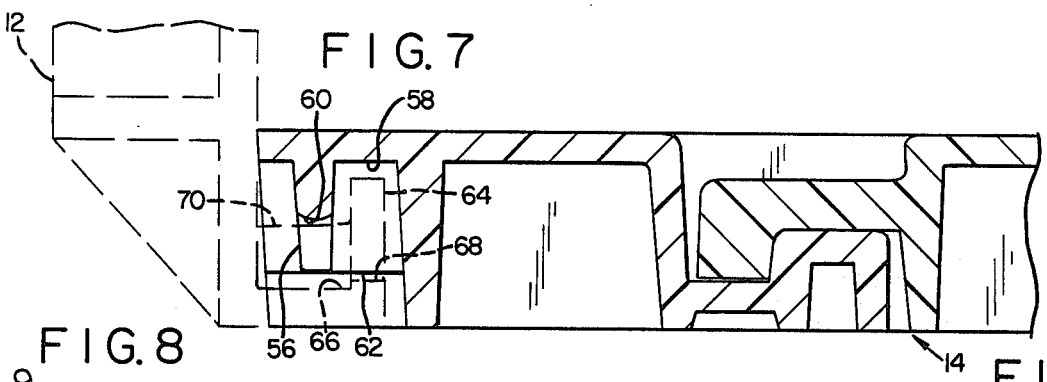
FIG. 7 is a cross-sectional view, taken along the line 7—7 in FIG. 3.

The various side and end walls are interconnected along adjacent side edges and with the walls in an upright position, by a joint which is effective to hold the walls upright and prevent them from pivoting outwardly from a vertical. The joint also interlocks the side edges to prevent relative longitudinal displacement. These features add strength to the bin with the walls upright, i.e., with the bin erected. More specifically, and referring to FIGS. 2, 3, and 7, it will be seen that wall 14 is provided with an elongate flange 56 that extends substantially the length of its edge which partially bounds an elongate groove 58 extending along one side of this flange. The flange is notched at 60 at intervals along the length thereof, and spanning groove 58 and distributed along the length of the groove are webs 62 which are an integral part of the end wall. Flange 56 is normal to and projects away from the inner face of end wall 14.

The edge of side wall 12 which is adjacent the edge of the end wall just described is provided with a flange 64 (see FIG. 7) extending substantially its length which projects inwardly from the edge of the side wall and is parallel to the inner face of side wall 12. This flange partially bounds a groove 66 and is notched at 68 with notches distributed along its length. Webs 70 are provided spanning groove 66 which are similar to webs 62 described in connection with end wall 14. With the walls upright and interconnected by the joint described, flange 64 moves into groove 58 and flange 56 moves into groove 66 with the flanges then lying side by side, the flanges and grooves preventing the respective walls from moving outwardly from a vertical. Interlocking the flanges to prevent relative longitudinal movement of the wall edges are webs 70 fitting within notches 60 and webs 62 fitting within notches 68.

A latch means is provided at each of the corners of the bin for latching adjacent edges whereby an end wall is held from pivoting inwardly from an upright position. Specifically, and referring to FIG. 3, such comprises a slide latch member 72 including a handle portion 74 and an extension 76 joined to the handle portion and projecting to one side thereof. The extension is slidably mounted within an accommodating slot provided in a boss 80 and a reinforcing flange 82 which is part of the end wall, permitting the slide latch member to be shifted from a retracted position to an extended position where the extension such extends beyond the reinforcing flange. With the slide latch member extended, the end of extension 76 moves into a suitable pocket provided in the adjacent edge of side wall 12, to produce an interlocked connection.

It should be understood that a joint similar to the joint described is provided at each of the four corners of the bin.

As will now be described, means is provided according to this invention providing access to the interior of the bin with the walls upright through a side of the container, the means contemplated being such as not to affect the integrity of the corner joint structure described which maintains the walls in their upright position. Specifically, it is contemplated that at least one of the walls of the bin (in the embodiment of the invention herein illustrated such comprising the end wall 14 which faces the viewer in FIG. 2, the wall being shown in greater detail in FIGS. 3–10) be a sectional wall, the wall including an outer frame section which detachably mounts what is referred to herein as a removable access panel.

Figure 3:
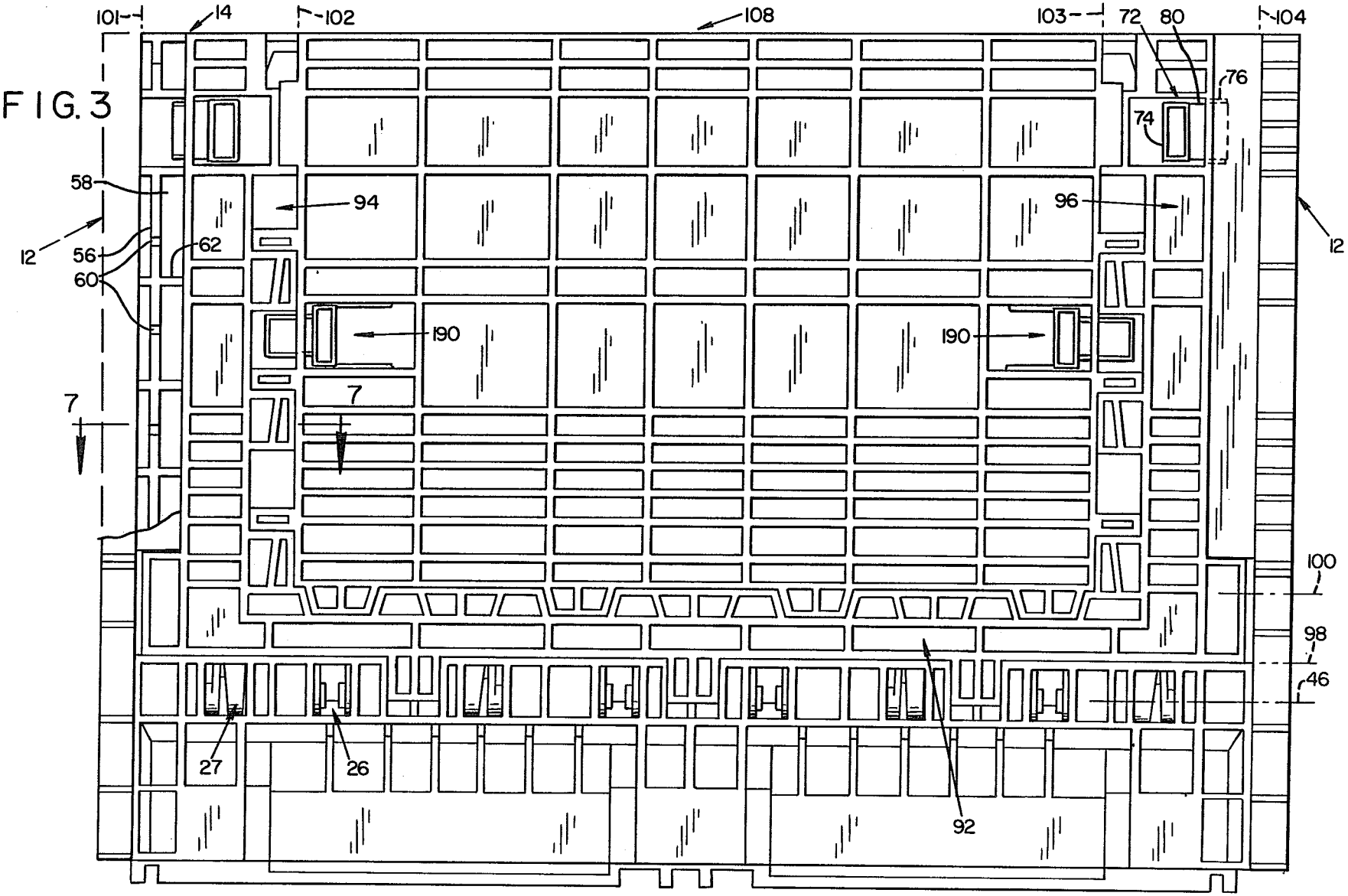
FIG. 3 is a side elevation of the side of the bin in FIGS. 1 and 2 which includes a sectional wall, this side being the side which faces toward the viewer and to the left in FIGS. 1 and 2.
Figure 6:
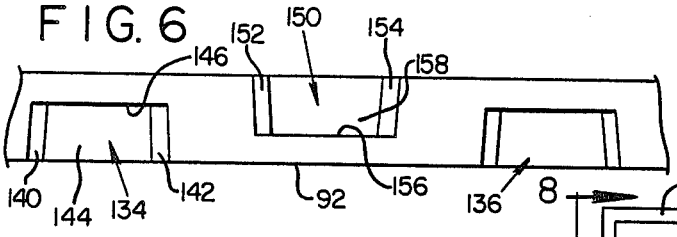
FIG. 6 is a view, taken generally along line 6—6 in FIG. 5.
Figure 4:
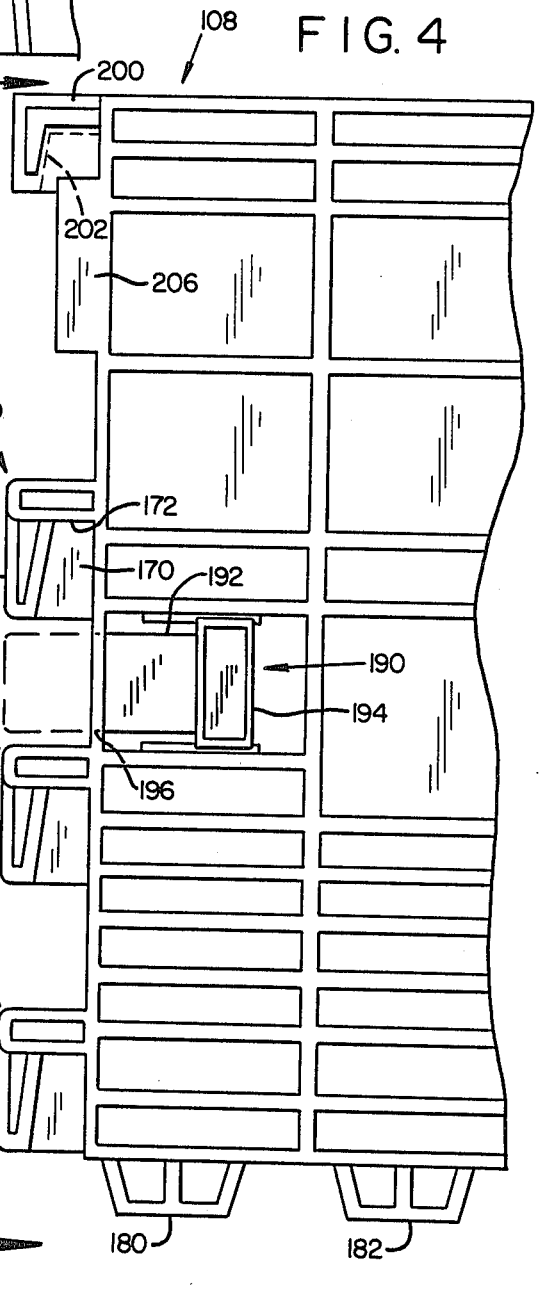
FIG. 4 is a side elevation, illustrating a portion of a detachable access panel in the sectional wall.

Further describing the sectional nature of end wall 14, and referring to FIGS. 3, 4 and 5, the end wall includes what is referred to herein as an outer frame section 90 having what might be thought of as an inverted yoke shape formed by an elongate bottom expanse 92, and joined to this bottom expanse and projecting upwardly along side margins, leg expanses 94, 96. To aid the viewer, in FIG. 3 the bottom expanse extends along the wall as such is illustrated approximately in the region delineated between extensions of lines 98 and 100 where such extend across the end wall. The two leg expanses extend vertically in the regions approximately delineated between lines 101 and 102 (in the case of leg 94) and lines 103, 104 (in the case of leg 96). The opposing legs and bottom expanse define an opening generally shown at 106 in FIG. 5, this opening being the access opening which receives and is closed off by a detachably mounted access panel, shown at 108 in FIG. 4.

Figure 11:
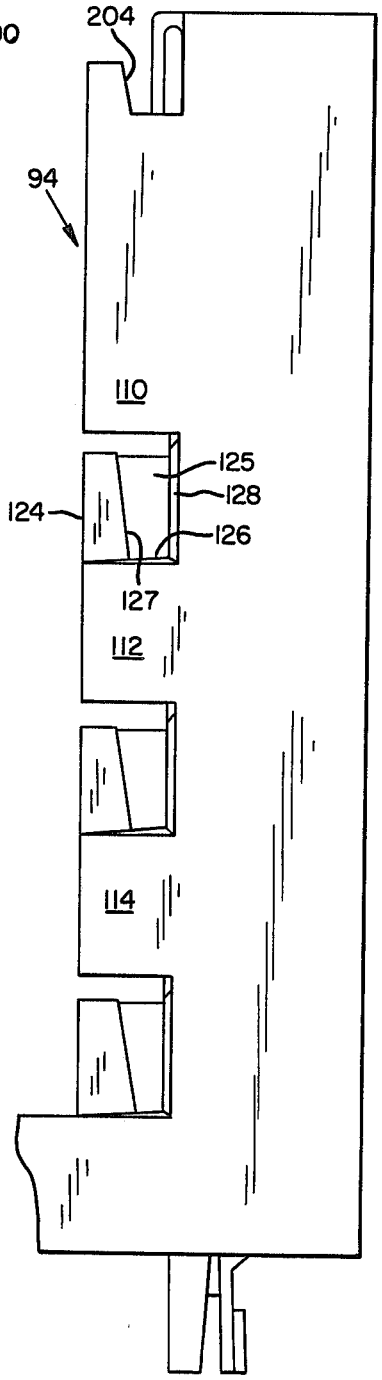
FIG. 11 is a view, taken generally along the line 11—11 in FIG. 10, illustrating the back of the leg in the sectional frame.
Figure 10:
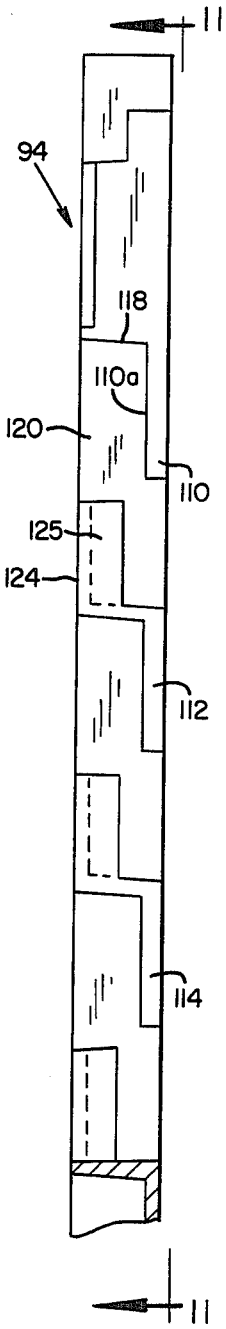
FIG. 10 is a view, taken generally along the line 10—10 in FIG. 5, illustrating an edge of a leg in the sectional frame of the wall.

Referring to FIG. 5, FIG. 10 (a view illustrating leg 94 as viewed from right to left in FIG. 5), FIG. 11 (illustrating the back of leg 94) leg 94 is provided with three, what are referred to herein as back-up abutment plate segments 110, 112, 114. Each has a surface facing the exterior of the outer frame section, as illustrated for plate segment 110 at ll0*a*, that extends vertically but is recessed well inwardly of the general plane of the exterior of the outer frame section. Extending partially about the perimeter of each of the plate segments, and as exemplified by segment 110, are flange surfaces 118, 120 extending normal to surface ll0*a* of the plate segment. The flange surfaces together with surface 110*a* define a reception pocket recessed inwardly from the exterior surface of the wall frame section. Similar reception pockets are formed in conjunction with back-up abutment plate segments 112, 114.

Socket structure is provided below each of the reception pockets defined by the plate segments 110, 112, 114 and associated flange surfaces. Further explaining, and considering the socket structure associated with plate segment 110, shown at 124 is a socket expanse located generally toward the viewer as such is shown in FIG. 5 from plate segment 110. The socket expanse on its inner side, i.e., the side facing the interior of the bin, is provided with a tapered recess 125 bottomed by a floor 126 and sides 127, 128, side 127 converging on side 128 progressing downwardly. This tapered recess provides a socket positioned below back-up abutment plate segment 110. Similar sockets are provided by socket expanses 130 and 132 located below plate segments 112 and 114. It should be further understood that leg 96 of the outer frame section is provided with back-up abutment plate segments and socket expanses similar to those just described, located on the margin of the leg which borders opening 106.

Bottom expanse 92 is formed with a series of well sockets distributed along the length thereof. Thus, and referring to FIGS. 5 and 6, appearing at spaced intervals along the exterior side of the bottom expanse are socket wells 134, 136. Each is defined, as exemplified by well 134, by flange surfaces 140, 142 that converge on each other progressing downwardly, and a flange surface 144 forming the base of the socket well. The rear side of the socket well is defined by a surface 146. The socket well opens to the exterior of the bin.

Distributed with socket wells 134, 136 are wells such as well 150 which face the interior of the bin. These are defined by side surfaces 152, 154 that converge on each other, a backing surface 156, and a floor 158.

The access panel includes projecting tongue portions configured to be detachably received within the socket openings provided along the margins of the legs in the outer frame section and within the socket wells which are provided along the upper part of bottom expanse 92.

Figure 8:
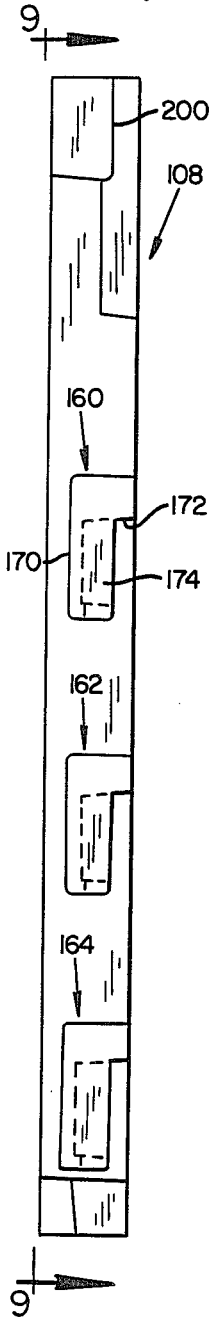
FIG. 8 is a view, taken generally along the line 8—8 in FIG. 4, illustrating an edge in the access panel.
Figure 9:
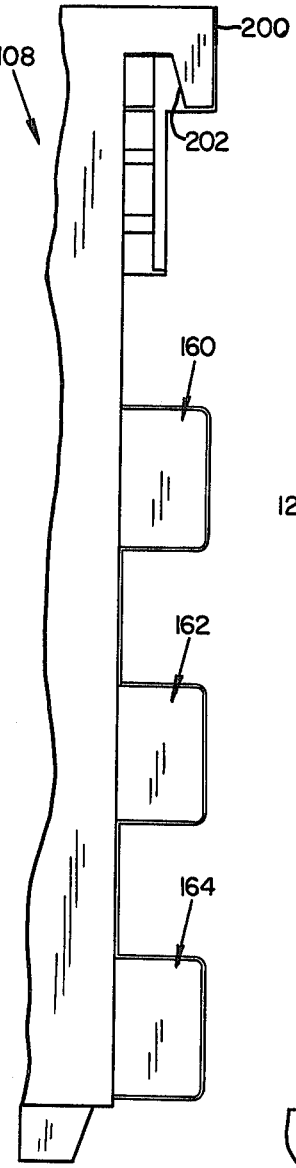
FIG. 9 is a view, taken generally along the line 9—9 in FIG. 8, illustrating the back of the edge of the access panel.

Further explaining, and referring to FIG. 4, FIG. 8 (a view looking at the edge of the access panel), and FIG. 9 (showing the back of the access panel), distributed along the length of the left margin of the access panel as illustrated in FIG. 4 are tongue projections 160, 162 and 164. Each, and considering tongue projection 160, includes a wall 170 forming the back of the tongue projection, a shoulder 172 adjacent the upper part of the tongue projection extending inwardly from the general plane of the exterior of the access panel, and a wedge or V-shaped tongue 174 extending downwardly from shoulder 172 and located in a region slightly to the rear of the exterior surface of the access panel. Wall 170 has outer dimensions which enables such to be fitted within the reception pocket previously described in connection with back-up abutment plate segment 110 defined by the surface of this plate segment and flange surfaces 118, 120. When fitted within this reception pocket, tongue 174 becomes positioned over tapered socket opening 125 which is provided in socket expanse 124. Tongue projections 162, 164 are similarly fitable within reception pockets associated with plate segments 112, 114 of the outer frame section. Further, and while not specifically described, tongue projections along the side margin of the access panel opposite to the one illustrated in FIG. 4 fit within reception pockets provided in the adjacent margin of leg 96.

The base of the access panel is provided with a series of downwardly projecting tongues 180 projecting downwardly from adjacent the exterior surface of the access panel fitable within socket wells 134, 136. Also projecting downwardly from the bottom of the access panel but spaced rearwardly from the tongues 180 are tongues 182 positioned to be received within the wells 150 provided in the bottom expanse.

Provided on each side of the access panel is a slide latch member 190 including an extension 192 and handle 194, similar to slide latch member 72. Extension 192 is received within an aperture 196. With the access panel in place, the slide latch member is shiftable to the left from the position shown in FIG. 4 to be positioned underneath socket expanse 124 in the outer frame section. With such positioning, the access panel is latched in such a manner as to prevent its removal from the outer frame section.

Referring to FIGS. 4 and 9, adjacent the top and each edge of the access panel is a protrusion 200 with a wedge element 202 carried on its inner face. Each leg (see FIGS. 5 and 11) has a socket recess 204 shaped to receive the wedge element with final positioning of the access panel. A web 206 extending generally in the plane of the exterior surface of the access panel overlies a shoulder 208 with the access panel finally positioned and in place.

Considering now the manner of mounting and detaching the access panel from the access opening presented by the outer frame section of the wall, it will be assumed initially that the access panel is removed and separate from the outer frame section, with these parts as illustrated in FIGS. 4 and 5.

To mount the access panel in the access opening, the access panel is shifted to place it slightly outwardly of the outer frame section and tongue projections 160, 162, 164 on each side of the access panel in front of and slightly spaced from plate segments 110, 112 and 114. With such positioning the panel and its tongue projections, the panel may be moved rearwardly, to place the access panel in the plane of the outer frame section and with its tongue projections lying directly against the plate segments and within the reception pockets associated with the plate segments. With this positioning, the tongues directly overlie the tapered sockets exemplified by socket 125 presented along the inner margins of the legs in the outer frame section. Tongues 180, 182 along the bottom edge of the access panel become positioned directly over socket wells 134, 150 in the bottom expanse of the outer frame section. With the access panel so positioned, and with subsequent movement of the access panel downwardly relative to the outer frame section, the various tongues on the side edges of the access panel become seated in tapered sockets 125, and tongues 180, 182 become seated in socket wells 134, 150. Walls 170 of the tongue projections, along their rear and upper margins, bear on plate segments 110, 112, 114. Tongues 180, 182 at the bottom of the access panel are in straddling relationship with respect to the bottom expanse of the outer frame section.

It will be seen from this description that a firm mounting has been disclosed for the access panel. When mounted, the panel is firmly locked from movement extending generally normal to the plane of the sectional wall. The mounting of the access panel provides interlocking with the outer frame section at spaced locations distributed about the entire perimeter of the access panel.

Having explained the mounting of the access panel, its removal, once in place, should be obvious. Generally speaking, the access panel is first lifted to free the tongue projections from any engagement with the socket expanses 125 and to place them in covering relation over the plate segments 110, 112, 114. This also frees the lower tongues from the wells in the bottom extent of the outer frame section. After being so positioned, the access panel is removed by pulling such forwardly of the exterior surface of the outer frame section in the sectional wall.

While a particular embodiment of the invention has been described, obviously changes and variations would be possible without departing from the invention.

It is claimed and desired to be secured by Letters Patent:

1. A collapsible container comprising:

a base, including a floor portion forming the floor of the container, an opposing pair of side walls and an opposing pair of end walls, and hinge means pivotally mounting said side and end walls on said base with the side and end walls being pivotable between an upright position and a collapsed, folded position disposed over said floor portion of the container, a side edge of an end wall being disposed adjacent a side edge of a side wall at each corner of the container with the side and end walls in their upright position and means interconnecting respective adjacent side edges of said side and end walls operating to hold the side and end walls upright, at least one of said pivotally mounted walls of said container being a sectional wall and including an outer frame section with a bottom expanse and opposed legs joined to and extending upwardly from the bottom expanse, the bottom expanse and legs bounding an opening and forming the perimeter of said one wall along the base and side edges of said one wall, a removable access panel having a bottom margin and opposed side margins, and interengaging means detachably mounting the removable access panel on said outer frame section, said interengaging means comprising tongues on the access panel projecting downwardly on the access panel distributed along the bottom margin of the access panel and along the side margins of the access panel and sockets on the outer frame section distributed along the bottom expanse of the frame section and along the legs of the frame section and facing upwardly on the frame section, the tongues seating within said sockets and when so seated being effective firmly to unite the bottom margin and sides of the access panel with the bottom expanse and legs of the outer frame section.

2. The container of claim 1, and further including shiftable latch means interposed between the access panel and frame section, shiftable to a latching position and in said latching position holding said access panel from movement in a direction extending generally in the plane of the sectional wall.

3. The collapsible container of claim 1, wherein the legs of the outer frame section further include means forming receptor pockets disposed above said sockets adapted to have said tongues seat therewithin, said receptor pockets with said tongues seated therewithin pre-positioning the tongues above said sockets.

4. A collapsible container comprising:

a base including a floor portion forming the floor of the container, an opposing pair of side walls and an opposing pair of end walls, one of said walls being a sectional wall and including an outer frame section with leg expanses forming the side margins of the sectional wall and a bottom expanse forming the bottom margin of the sectional wall and further including a removable access panel and means detachably mounting the access panel on said outer frame section, said side and end walls being mounted on said base so as to permit collapsing of the container with stacking of said walls above said base, the mounting of said sectional wall on said base interconnecting the base and the bottom expanse of the frame section of the sectional wall, a side edge of an end wall being disposed adjacent a side edge of a side wall at each corner of the container with the side and end walls in their upright position and means interconnecting respective adjacent side edges of said and end walls operating to hold the side and end walls upright, the means interconnecting the side edge of the sectional wall connecting with a leg expanse of the outer frame in the wall, the means detachably mounting the access panel including interlocking socket and tongue structure presented by the outer frame section and the access panel, said socket and tongue structure extending along the leg expanses and margins of the access panel which are adjacent the leg expanses and comprising tongues integral with the access panel and facing downwardly and sockets integral with the leg expanses and facing upwardly, the leg expanses of the frame section further including receptor pockets disposed above said sockets accommodating prepositioning of the tongues of the access panel.

* * * * *